US008506233B2

(12) United States Patent
Havakechian et al.

(10) Patent No.: US 8,506,233 B2
(45) Date of Patent: Aug. 13, 2013

(54) AXIAL TURBINE AND METHOD FOR DISCHARGING A FLOW FROM AN AXIAL TURBINE

(75) Inventors: Said Havakechian, Baden (CH); Thomas Mokulys, Würenlingen (CH); Vishal Borikar, Nussbaumen (CH); Patrick Vu, Nussbaumen (CH)

(73) Assignee: ALSTOM Technology Ltd., Baden (CH)

( * ) Notice: Subject to any disclaimer, the term of this patent is extended or adjusted under 35 U.S.C. 154(b) by 432 days.

(21) Appl. No.: 12/880,240

(22) Filed: Sep. 13, 2010

(65) Prior Publication Data

US 2011/0064560 A1 Mar. 17, 2011

(30) Foreign Application Priority Data

Sep. 14, 2009 (EP) ..... 09170201

(51) Int. Cl.
*F04D 27/02* (2006.01)

(52) U.S. Cl.
USPC ..... 415/1; 415/130; 415/160

(58) Field of Classification Search
USPC ..... 415/1, 66, 76, 84, 129, 130, 133, 415/134, 135, 139, 151, 159, 160, 191, 193, 415/198.1, 208.1, 208.2, 212.1
See application file for complete search history.

(56) References Cited

U.S. PATENT DOCUMENTS

| | | | | |
|---|---|---|---|---|
| 1,697,174 A | | 1/1929 | Forner | |
| 3,285,567 A | * | 11/1966 | Richardson | 415/148 |
| 3,285,568 A | | 11/1966 | Richardson | |
| 5,518,366 A | * | 5/1996 | Gray | 415/226 |
| 5,796,199 A | | 8/1998 | Charbonnel | |
| 7,743,497 B2 | | 6/2010 | Gautreau et al. | |

FOREIGN PATENT DOCUMENTS

| | | |
|---|---|---|
| CH | 361081 | 5/1962 |
| DE | 1935534 | 3/1966 |
| DE | 60026803 | 12/2006 |
| EP | 0690206 | 1/1996 |
| EP | 1178183 | 2/2002 |
| EP | 1561911 | 8/2005 |
| EP | 1892384 | 2/2008 |
| EP | 2080871 | 7/2009 |
| GB | 11890 | 0/1911 |

OTHER PUBLICATIONS

European Search Report for EP Patent App. No. 09170201.9 (Mar. 29, 2010).

Search Report for German Patent App. No. 10 2010 044 819.2 (Feb. 17, 2011).

* cited by examiner

*Primary Examiner* — Edward Look

*Assistant Examiner* — Juan G Flores

(74) *Attorney, Agent, or Firm* — Cermak Nakajima LLP; Adam J. Cermak

(57) ABSTRACT

An axial turbine (1) has a plurality of expansion stages (2) each defined by stator blades (13) and rotor blades. The expansion stages (2) are followed by an exhaust diffuser (4) for collecting the flow passing through the expansion stages (2) and discharging it to the outside. The expansion stages (2) and/or the diffuser (4) have at least a non-axial symmetric portion. The stator blades (13) define different openings (17) along the circumference of the turbine.

12 Claims, 5 Drawing Sheets

AXIAL TURBINE AND METHOD FOR DISCHARGING A FLOW FROM AN AXIAL TURBINE

This application claims priority under 35 U.S.C. §119 to European application no. No. 09170201, filed 14 Sep. 2009, the entirety of which is incorporated by reference herein.

BACKGROUND

1. Field of Endeavor

The present invention relates to an axial turbine and a method for discharging a flow from an axial turbine, wherein the turbine is a steam turbine.

In particular the present invention refers to a design for the guide vane of the last stage and/or for the stages upstream and/or downstream of extraction slits, which favorably influences the work extraction and the flow in the exhaust diffuser.

2. Brief Description of the Related Art

Steam turbines are known to have a cylinder including a plurality of expansion stages made of stator/rotor blades.

The stator blades of each stage are all identical, arranged with identical geometrical configuration (i.e., they have the same stagger angle, etc) and define guide vanes that are identical; in the same way, also the rotor blades of each stage are all identical, are arranged with the same geometrical configuration (i.e., they have the same stagger angle, etc) and define paths that are identical.

Downstream of the expansion stages, steam turbines have an exhaust diffuser that collects the steam coming from the expansion stages and typically (for power production plants) discharges it into a condenser.

The exhaust diffuser is made of an axial-symmetric portion that gathers the steam coming from the last expansion stage and feeds it to a non axial-symmetric collector, having an upper quasi-circular casing portion and a lower discharging casing portion with a rectangular opening connected to a condenser neck.

During operation, the steam passes through the expansion stages and delivers mechanical power to the rotor blades (and thus to a turbine shaft connected to the rotor blades).

Subsequently, the steam flowing out of the last expansion stage enters the exhaust diffuser, where it is collected and discharged into the condenser.

Nevertheless, as the expansion stages of the turbine are axial symmetric, whereas the collector of the exhaust diffuser is neither axial symmetric, nor extends in the same direction as the expansion stages, when passing through the exhaust diffuser the steam flow undergoes large circumferential distortions.

This causes the operating conditions of the steam in the last expansion stage (in particular in the circumferential direction) to be influenced, such that in the last expansion stage the operating conditions of the steam are not circumferentially uniform.

Moreover, flow circumferential distortions cause non-uniform mixing losses within the steam flow and differing pressure drops that can worsen the overall efficiency of the steam turbine.

The same drawbacks are caused by non-axial-symmetric portions of the turbine, defined, for example, by extraction slits; in this case the steam flowing through the stage upstream and downstream of an extraction slit is influenced by the extraction slit.

SUMMARY

One of numerous aspects of the present invention includes an axial turbine and a method that allow counteracting the flow circumferential distortions caused by the non axial-symmetric configuration of the exhaust diffuser and/or a turbine portion provided with extraction slits.

Another aspect of the invention includes an axial turbine and a method which allow counteracting the non-uniformities of the operating conditions.

Another aspect includes an axial turbine and a method by which the mixing losses (due to the aforementioned non-uniformities) and pressure drops of the steam flow are reduced and the overall efficiency of the steam turbine is increased.

BRIEF DESCRIPTION OF THE DRAWINGS

Further characteristics and advantages of the invention will be more apparent from the description of a preferred but non-exclusive embodiment of the axial turbine and method according to the invention, described with reference to the enclosed drawings, in which.

DETAILED DESCRIPTION OF EXEMPLARY EMBODIMENTS

Figure 1:
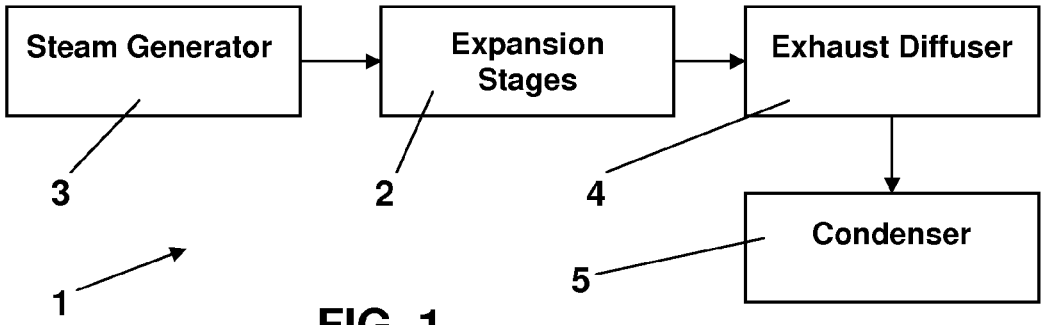
FIG. 1 is a sketch of a steam turbine.

With reference to the figures (in particular FIG. 1), these schematically show an axial turbine overall indicated by the reference number 1.

The turbine 1 is a steam turbine and includes a plurality of expansion stages 2 where the high pressure and high temperature steam flow generated by a steam generator 3 is expanded to extract mechanical power.

Downstream of the expansion stages 2 the steam turbine 1 includes an exhaust diffuser 4 that collects the steam flow passing through the expansion stages 2 and discharges it to the outside (into a condenser 5) along a direction different from that of the turbine axis.

Figure 3:
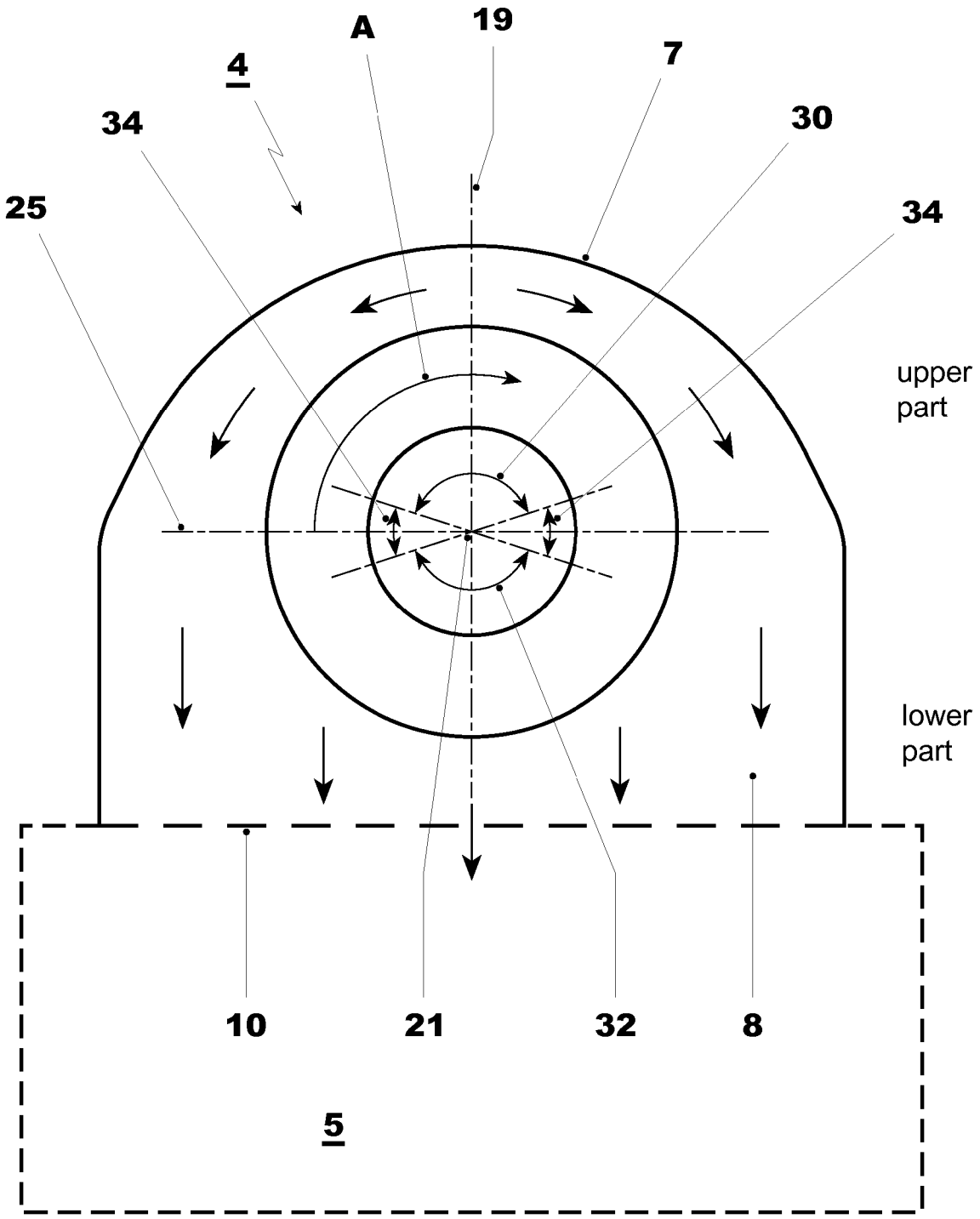
FIG. 3 is schematic front view of the turbine from the side of the exhaust diffuser.

FIG. 3 shows the turbine axis 21 of the turbine along which the steam flow propagates in the expansion stages 2, and the axis 19 along which the steam flow is diverted in the exhaust diffuser 4 to be discharged into the condenser 5.

Each expansion stage is defined by stator blades and rotor blades.

The stator blades are fixed to a blade carrier and define a plurality of blade flow guide vanes through which the steam flow passes.

The rotor blades are assembled to a rotor core and define a plurality of paths (each path is defined between two adjacent rotor blades).

Figure 6:
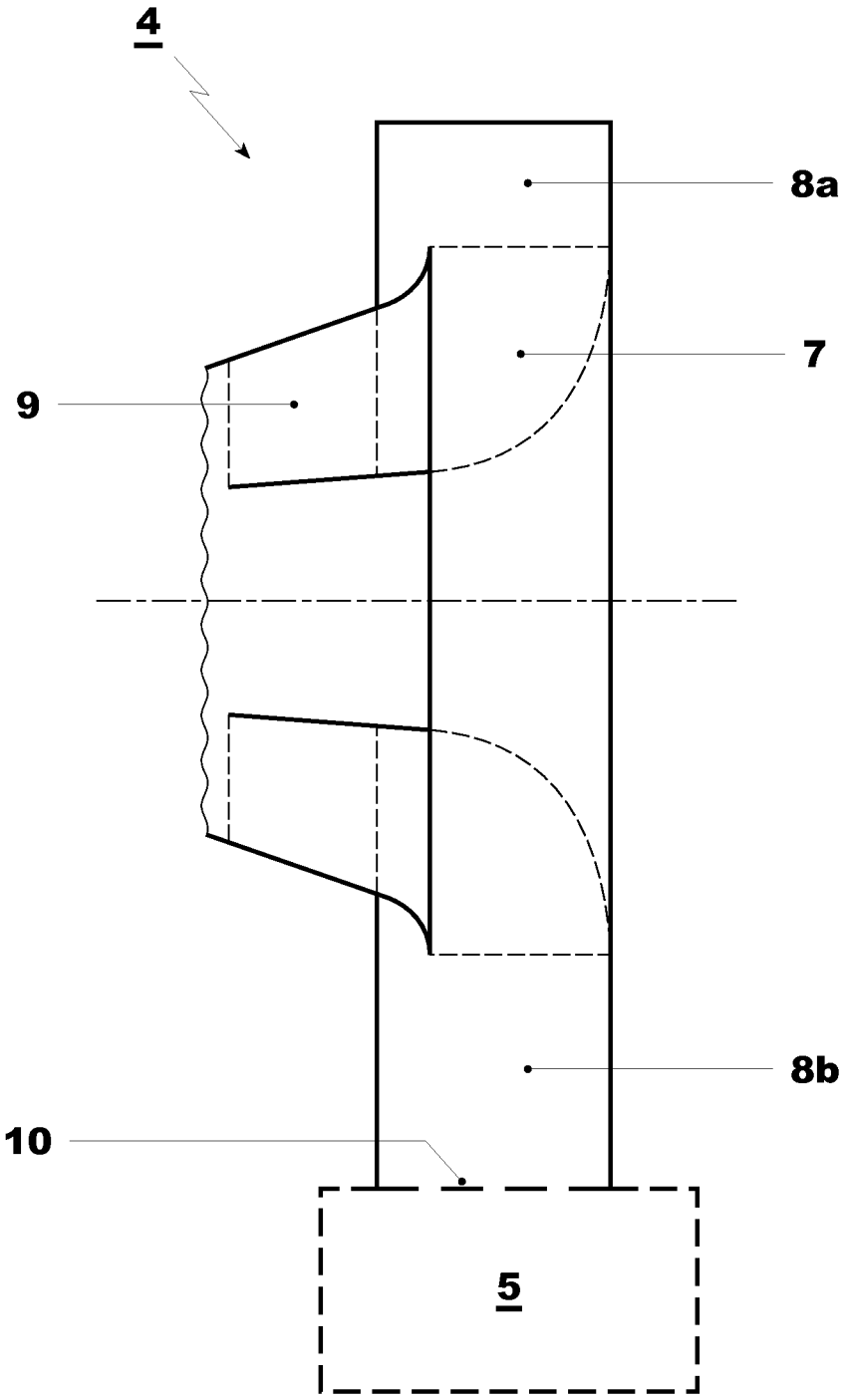
FIG. 6 shows a side view of an end of the turbine with the diffuser connected thereto.

The diffuser 4 (FIG. 6) includes an axial-symmetric portion 7 that gathers the steam coming from the last expansion stage 9, and a non-axial-symmetric collector 8 connected to the neck of the condenser 5.

The non-axial-symmetric collector 8 includes an upper part 8*a* that is made of a quasi-circular or curved casing, and a lower discharging part 8*b* that has plane walls and is provided with an aperture 10 in communication with the condenser 5.

Figure 2:
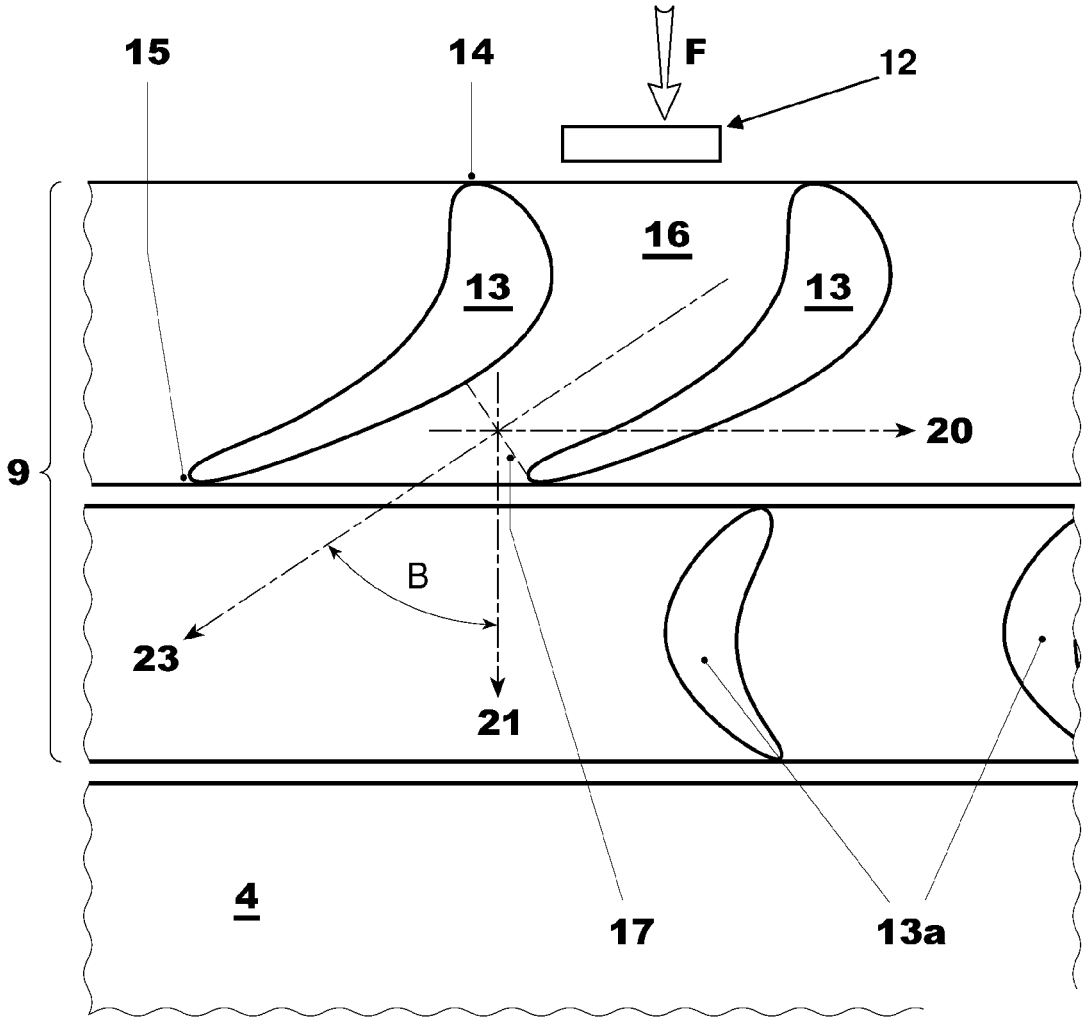
FIG. 2 partly shows an expansion stage adjacent to an exhaust diffuser.

FIG. 2 shows the last expansion stage 9 (i.e., the expansion stage adjacent to the diffuser 4) that includes the stator blades 13 (in this figure only two stator blades 13 are shown) and downstream of them the rotor blades 13*a* (in this figure only two rotor blades are shown); arrow F indicates the steam flow global direction.

The stator blades 13 have leading edges 14 and trailing edges 15; moreover each couple of two adjacent stator blades 13 defines the guide vanes 16 having openings 17 that define the smallest passing through cross section of the guide vane.

Advantageously, the stator blades 13 of one of the expansion stages define different openings 17 along the circumference of the turbine.

In particular, as shown in the figures, the stator blades 13 that define different openings 17 are those of the stage adjacent to the diffuser 4.

Thus the steam turbine has the stator blades 13 according to principles of the present invention; these stator blades 13 are followed by rotor blades 13*a* that are all identical (as in traditional turbines) and, downstream of the rotor blades 13*a*, the steam turbine has the diffuser 4.

In FIG. 2, reference number 20 indicates the circumferential direction and reference number 21 indicates the turbine axis.

As the stator blades 13 are all the same, in order to define different openings 17 the stator blades 13 have different gauge angles B defined between the turbine axis 21 and an axis 23 perpendicular to the opening 17.

In a preferred embodiment, the stage adjacent to the exhaust diffuser 4 has a first group 30 of stator blades having a first gauge angle B1 between the turbine axis 21 and the axis 23, and a second group of stator blades 32 having a second gauge angle B2 between the turbine axis 21 and the axis 23, with the first angle B1 different from the second angle B2.

In particular the first group 30 of stator blades 13 is at the upper zone of the exhaust diffuser 4 and the second group 32 of stator blades is at the lower zone of the exhaust diffuser 4 and the first angle B1 is smaller than the second angle B2, such that the openings 17 between the stator blades 13 of the first group 30 are greater than those between the stator blades 13 of the second group 32.

Likewise, according to the particular design and operating conditions forecasted for the turbine, also different embodiments are possible and, for example, the first angle B1 may also be greater than the second angle B2, such that the openings 17 between the stator blades 13 of the first group 30 at the upper zone are smaller than those between the stator blades 13 of the second group 32 (lower zone).

Moreover, the stator blades 13 of the first group 30 are symmetrically arranged about the axis 19 (that is, the axis of symmetry of the exhaust diffuser 4) and the stator blades 13 of the second group 32 are also symmetrically arranged about the same axis 19.

In a preferred arrangement, the turbine of the invention also includes a third group 34 of stator blades having angles B3, B4 . . . between the turbine axis 21 and the axis 23 different from the first and second angles B1, B2 and between the first and the second angles B1, B2. The blades of the third groups 34 are placed between the blades of the first and second groups 30, 32 and let the flow be conditioned, to avoid sharp change of conditions.

For example, the first group of blades 30 has blades all having the same angle B1, the second group 32 of blades comprises blades having all the same angle B2, and the third group 34 of blades has blades having angles B3, B4, B5; the third group 34 of blades is arranged at both transition zones between the first and second group 30, 32 of blades.

Figure 4:
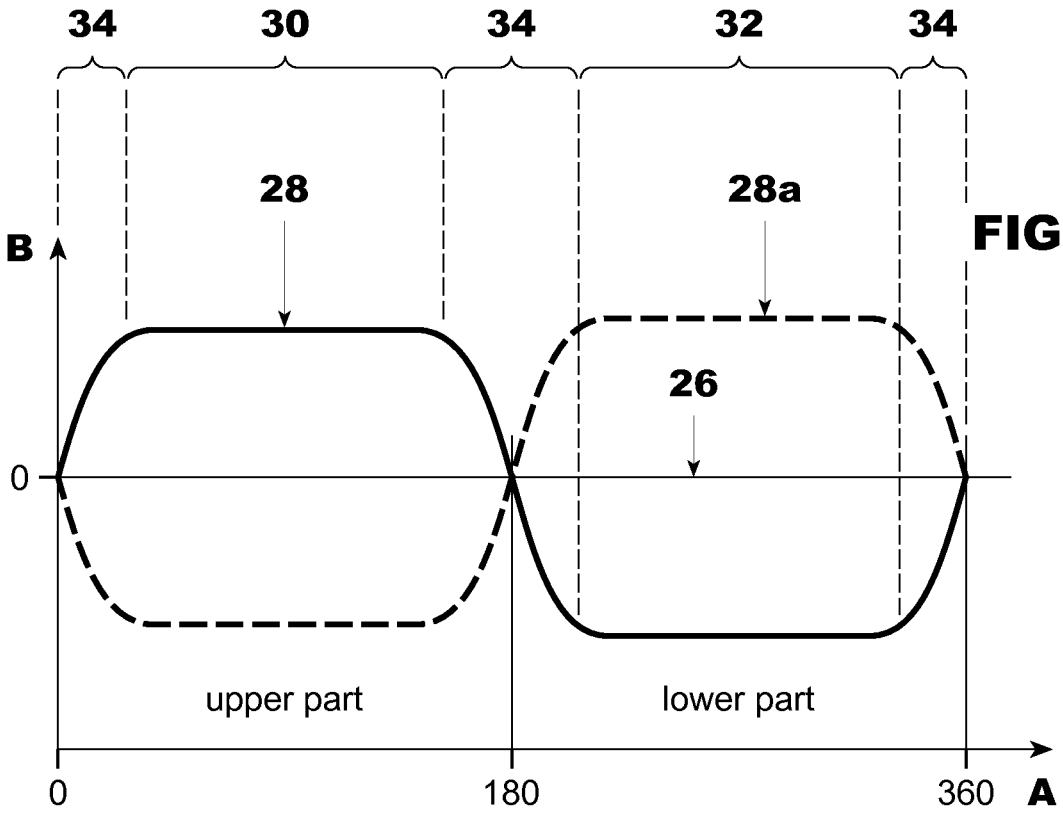
FIG. 4 is a diagram showing the re-staggering angle of the stator blade defined between the turbine axis and an axis normal to the openings of the guide vanes.

FIG. 4 schematically shows the variation of angle B in the circumferential direction defined by angle A drawn with respect to the horizontal axis 25 (see also FIG. 3).

In particular, the zone defined between 0-180 is the upper part of the turbine, and the zone between 180-360 is the lower part of the turbine.

This diagram is drawn with respect to a baseline 26 that defines the optimized gauge angle $B_{opt}$ between the turbine axis 21 and the normal 23 to the openings 17 calculated in a traditional way (i.e., for a stator with all the openings 17 being the same); curves 28 and 28*a* of FIG. 4 describes the deviation of the angle B from this optimized angle $B_{opt}$.

Curve 28 shows the embodiment with angle B1 greater than angle B2 (thus openings 17 are smaller in the upper part than in the lower part) and curve 28*a* shows a preferred embodiment with angles B1 smaller than angles B2 (and thus openings 17 larger at the upper part than at the lower part).

The deviation of angles B1 and B2 is preferably the same.

The deviation of angles B1 and B2 is preferably between 2°-5°.

As shown, the overall deviation of the angle B from the $B_{opt}$ is zero.

In addition, as in the upper and lower parts angles B are different, the zones inbetween have angles B such that they match with each other.

In this respect in the zone astride of circumferential angles 0 (and 360) and 180, the curves 28 and 28*a* show that angles B are different from the first and second angles B1, B2 but have a value between them (this is the third group 34 of stator blades).

Figure 5:
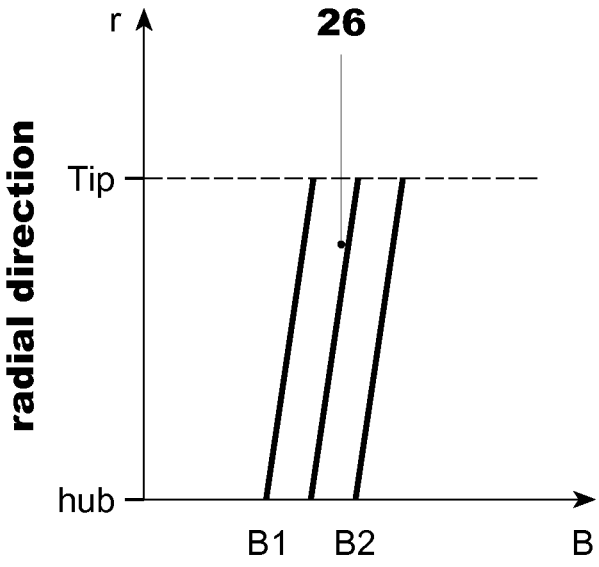
FIG. 5 is a diagram showing the angle of FIG. 4 with respect to the distance from the hub of each blade (i.e., with respect to the radial direction)

FIG. 5 shows a diagram indicating the angle B for each blade; in particular, FIG. 5 shows the baseline 26 and the two lines corresponding to angles B1 and B2. Angles B3, B4, B5 are between B1 and B2.

Figure 7:
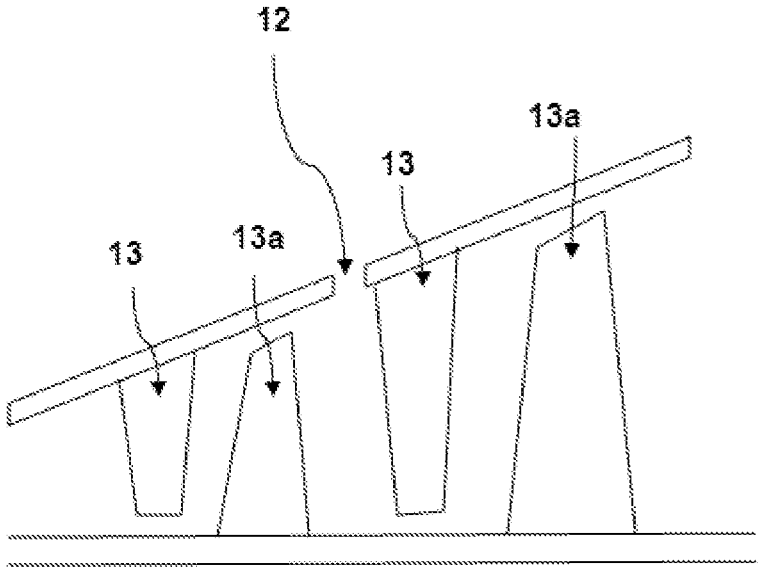
FIG. 7 a sectional view of a portion of the turbine with an extraction slit.

Embodiments of the invention have been discussed with particular reference to the exhaust diffuser; however, the stator blades placed upstream and/or downstream of extraction slits 12 (see FIGS. 2, 7) may be re-staggered as discussed (extraction slits are used to extract steam from the stages).

The operation of an axial turbine embodying principles of the present invention is apparent from that described and illustrated and is substantially the following.

The steam flow generated by the steam generator 3 enters the expansion stages 2 and delivers mechanical power to the rotor.

In the following, reference to the preferred embodiment with openings 17 at the upper part larger than those at the lower part, is made.

At the last stage 9 (the stage upstream of the exhaust diffuser 4) the steam flow is diverted such that a greater amount of flow is driven towards the upper part of the diffuser 4 (i.e., close to the aperture 10 of the diffuser 4) and a smaller amount of steam flow is driven towards the lower part of the diffuser (i.e., close to the collecting zone 7 of the diffuser 4).

This steam flow distribution lets more uniform operating conditions be achieved and mixing losses and pressure drops at the diffuser be reduced such that an overall increase in efficiency is achieved.

The present invention also relates to a method for discharging a flow from the axial turbine having a plurality of expansion stages followed by a diffuser for collecting and discharging the flow passing through the expansion stages, wherein the expansion stages 2 and/or the exhaust diffuser 4 have at least a non-axial symmetric portion.

An exemplary method includes differently driving the flow within the expansion stages according to the angular position along the circumference of the turbine.

In particular, according to methods embodying principles of the present invention, only the flow in an expansion stage upstream of the diffuser 4 and/or upstream and/or downstream of an extraction slit 12 is differently driven and only the stator blades differently drive the flow (i.e., not the rotor blades).

In practice the materials used and the dimensions can be chosen at will according to requirements and to the state of the art.

REFERENCE NUMBERS

1 steam turbine
2 expansion stages
3 steam generator
4 exhaust diffuser
5 condenser
7 axial symmetric portion of the exhaust diffuser
8 non-axial-symmetric collector
8*a* upper part of the non-axial symmetric collector of the exhaust diffuser
8*b* lower discharging part of the non-axial symmetric collector of the exhaust diffuser
9 last expansion stage
10 aperture
12 Extraction Slit
13 stator blades
13*a* rotor blades
14 leading edges
15 trailing edges
16 guide vane
17 opening
19 axis of symmetry of the exhaust diffuser
20 circumferential direction
21 turbine axis
23 axis perpendicular to the opening
25 horizontal axis perpendicular to the axis 19
26 baseline
28 deviation of B
28*a* deviation of B
30 first group of stator blades
32 second group of stator blades
34 third group of stator blades
A angle between the horizontal axis 25 and a generic radial axis
B angle between the turbine axis and the axis perpendicular to the opening
F steam flow global direction While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. An axial turbine comprising:
a plurality of expansion stages each including and defined by stator blades and rotor blades;
a diffuser fluidly downstream of the expansion stages configured and arranged to collect the flow passing through the expansion stages and discharge it;
wherein the expansion stages, the diffuser, or both have at least a non-axial symmetric portion;
wherein stator blades of at least one of the expansion stages define different openings along the circumference of the turbine than openings between other stator blades of the same expansion stage.

2. An axial turbine as claimed in claim 1, further comprising:
an extraction slit; and
wherein the stator blades defining different openings are blades of a stage adjacent to the diffuser, a stage upstream of the extraction slit, a stage downstream of the extraction slit, or combinations thereof.

3. An axial turbine as claimed in claim 2, wherein said stator blades defining different openings have different angles defined between the axial direction and an axis perpendicular to the opening, to define different openings.

4. An axial turbine as claimed in claim 3, wherein said stator blades defining different openings comprise a first group of stator blades having a first angle between the axial direction of the turbine and an axis perpendicular to the opening, and a second group of stator blades having a second angle between the axial direction of the turbine and an axis perpendicular to the opening, the first angle being different from the second angle.

5. An axial turbine as claimed in claim 4, wherein:
the first group of stator blades is adjacent to an upper portion of the exhaust diffuser and the second group of stator blades is adjacent to a lower zone of the exhaust diffuser; and
the first angle is smaller than the second angle, such that the openings between the stator blades of the first group are greater than the openings between the stator blades of the second group.

6. An axial turbine as claimed in claim 5, wherein the stator blades of the first group are symmetrically arranged about an axis of symmetry of the diffuser and the stator blades of the second group are symmetrically arranged about the same axis of symmetry of the diffuser.

7. An axial turbine as claimed in claim 4, wherein said stator blades defining different openings comprise a third group of stator blades having angles between the axial direction of the turbine and the perpendicular to the opening different from the first and second angles and between the first and the second angles.

8. An axial turbine as claimed in claim 1, wherein said turbine is a steam turbine and said flow is a steam flow.

9. A method for discharging a flow from an axial turbine having a plurality of expansion stages followed by a diffuser for collecting and discharging the flow passing through the expansion stages, wherein the expansion stages, the diffuser, or both have at least a non-axial symmetric portion, the method comprising:

differently driving the flow with the stator blades within the expansion stages according to the angular position along the circumference of the turbine.

10. A method as claimed in claim 9, wherein differently driving comprises driving the flow only in an expansion stage adjacent to the diffuser, in stages upstream of an extraction slit, in stages downstream of an extraction slit, or combinations thereof.

11. A method as claimed in claim 10, wherein differently driving comprises driving more flow in an upper zone of the exhaust diffuser than in a lower zone of the same exhaust diffuser.

12. A method as claimed in claim 9, wherein said turbine is a steam turbine and said flow is a steam flow.

* * * * *